US009254894B2

(12) United States Patent
Gu et al.

(10) Patent No.: US 9,254,894 B2
(45) Date of Patent: Feb. 9, 2016

(54) FLOTABLE SUBSEA PLATFORM (FSP)

(71) Applicant: CONOCOPHILLIPS COMPANY, Houston, TX (US)

(72) Inventors: Zhihao George Gu, Houston, TX (US); Chad A. Petrash, Fulshear, TX (US); Ivica T. Grgas, Houston, TX (US); Amal C. Phadke, Houston, TX (US); Dominique P. Berta, Flower Mount, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/178,055

(22) Filed: Feb. 11, 2014

(65) Prior Publication Data

US 2015/0225043 A1 Aug. 13, 2015

Related U.S. Application Data

(60) Provisional application No. 61/766,327, filed on Feb. 19, 2013.

(51) Int. Cl.

| | |
|---|---|
| ***B63B 35/44*** | (2006.01) |
| ***E21B 43/01*** | (2006.01) |
| ***E21B 19/00*** | (2006.01) |
| ***B63B 21/50*** | (2006.01) |

(52) U.S. Cl.

CPC ..... *B63B 35/44* (2013.01); *B63B 21/50* (2013.01); *E21B 19/002* (2013.01); *E21B 43/01* (2013.01); *B63B 2035/448* (2013.01)

(58) Field of Classification Search

CPC ..... E21B 19/002; E21B 43/01; E21B 43/017; E21B 41/08; E21B 15/02; B63B 35/4413; B63B 1/107; B63B 9/065; B63B 21/00; B63B 21/502; B63B 35/38; B63B 35/44; B63B 2001/044; B63B 2021/003; B65D 88/78

USPC ..... 405/209, 203, 204, 205, 206; 166/339, 166/341

See application file for complete search history.

(56) References Cited

U.S. PATENT DOCUMENTS

| | | | | | |
|---|---|---|---|---|---|
| 2,552,899 | A | | 5/1951 | Manes | |
| 2,684,575 | A | | 7/1954 | Pryor et al. | |
| 3,902,553 | A | | 9/1975 | Jergins | |
| 4,435,108 | A | * | 3/1984 | Hampton | 405/209 |
| 4,537,533 | A | * | 8/1985 | Hampton | 405/227 |
| 4,625,805 | A | * | 12/1986 | Ladecky | 166/341 |
| 4,702,321 | A | | 10/1987 | Horton | |
| 4,762,180 | A | | 8/1988 | Wybro et al. | |
| 4,784,527 | A | | 11/1988 | Hunter et al. | |

(Continued)

OTHER PUBLICATIONS

International Search Report. PCT/US2014/016029, Dated May 15, 2014.

*Primary Examiner* — John Kreck
*Assistant Examiner* — Carib Oquendo
(74) *Attorney, Agent, or Firm* — ConocoPhillips Company

(57) ABSTRACT

A subsea facility for hydrocarbon recovery in deep waters and methods of installation are provided. More specifically, the subsea facility equipment is on multiple modules equipped with a buoyancy system to allow the modules to sink to the sea floor. The modules can be attached and unattached to each other, thus allowing for a module to be raised to the surface for repairs without affecting the rest of the subsea facility.

2 Claims, 7 Drawing Sheets

(56) References Cited

U.S. PATENT DOCUMENTS

| | | | | |
|---|---|---|---|---|
| 4,909,671 | A | 3/1990 | Skjong | |
| 4,913,238 | A | 4/1990 | Danazcko et al. | |
| 5,439,321 | A | 8/1995 | Hunter | |
| 6,196,322 | B1 | 3/2001 | Magnussen | |
| 6,622,793 | B1 | 9/2003 | Rylov et al. | |
| 6,752,100 | B2 | 6/2004 | Morrison et al. | |
| 6,913,418 | B2 | 7/2005 | Chen et al. | |
| 7,011,473 | B2 | 3/2006 | Tangen et al. | |
| 7,703,534 | B2 | 4/2010 | Sheshtawy | |
| 2003/0180096 | A1 * | 9/2003 | Appleford et al. | 405/190 |
| 2004/0251030 | A1 * | 12/2004 | Appleford et al. | 166/357 |
| 2011/0164926 | A1 | 7/2011 | Joensen et al. | |
| 2011/0240303 | A1 | 10/2011 | Hallundbaek | |
| 2012/0234117 | A1 | 9/2012 | Oswald | |

* cited by examiner

FLOTABLE SUBSEA PLATFORM (FSP)

CROSS-REFERENCE TO RELATED APPLICATIONS

This application is a non-provisional application which claims benefit under 35 USC §119(e) to U.S. Provisional Application Ser. No. 61/766,327 filed Feb. 19, 2013, entitled "FLOATABLE SUBSEA PLATFORM," which is incorporated herein in its entirety

FEDERALLY SPONSORED RESEARCH STATEMENT

Not Applicable

REFERENCE TO MICROFICHE APPENDIX

Not applicable.

FIELD OF THE INVENTION

The present invention relates to subsea facilities in general, and in particular, to a subsea facility connected to multiple modules that are connected to form a floatable subsea platform. Such platforms can be floated to a desired position, and then sunk and anchored to the seafloor for use. If a particular module needs servicing, it can be disconnected from the rest of the platform, and floated to the surface for servicing.

BACKGROUND OF THE INVENTION

The oil and gas industry has been expanding its exploration and production operations from land to sea since the 1890s. The first submerged oil well was drilled in fresh waters in Ohio in 1891. In 1897, the first derrick was placed atop a wharf about 250 feet from the California shoreline. However, true offshore drilling and production did not take off until the first well was drilled completely out of site of land in 1947. Since then, advancing technology has allowed for the drilling of wells and recovery of oil and gas at greater water depths.

Underwater oil fields are generally split into shallow water and deep-water categories because different equipment and approaches are used for oil recovery. Shallow water drilling and recovery occurs at depths less than 500 feet and generally involve rigs that have legs long enough to reach the bottom of the sea floor.

As drilling extends further offshore, rigs have become larger and more complex to meet the hostile environment. Furthermore, time to perform operations are much greater in deep-water than shallow water operations. Thus, deep-water drilling has been economically infeasible in the past. But, rising oil prices and depleted shallow water fields are making deep-water drilling more and more attractive.

FIG. 1 displays the many types of deep-water production systems in use today. For deep-water drilling (>500 feet), semi-submersible drilling rigs and drillships have traditionally been used and use of other floating production systems are increasing. However, for huge water depths, these methods are not very cost effective. The ocean can add several hundred meters or more to the fluid column, which increases the equivalent circulating density and downhole pressures in drilling wells, as well as the energy needed to lift produced fluids for separation on the platform.

Subsea facilities that reside on the sea floor, are being increasingly used as they become being more economical and technically feasible for use at great water depths. Here, the subsea equipment is attached to a platform anchored to the sea floor and a flowline conducting the produced hydrocarbons is connected to another structure, such as a floating tanker.

With the equipment being located on the sea floor, subsea systems provide for a less expensive solution for a myriad of harsh conditions than is provided by other technology. Furthermore, the requirement for the system to work deep underwater potentially reduces oil spills because connections must be sealed to prevent water ingress. Equipment working at atmospheric pressure may not meet such design requirements. Thus, subsea installations can help to exploit resources at progressively deeper waters, at locations that have previously been inaccessible, and at locations with harsh environmental conditions, such as the Barents Sea where drifting sea ice can damage surface equipment.

Improvements in technology have allowed subsea facilities to perform numerous processes that have traditionally occurred at the surface, thus debottlenecking the processing capacity. For example, some newer processes being performed by subsea facilities include water removal and re-injection or disposal, single-phase and multi-phase boosting of well fluids, sand and solid separations, and gas/liquid separations. This reduces the need for flowlines and risers that lift these components from the subsea facility for separation and then return them back to the seafloor for re-injection.

However, a disadvantage of subsea production systems is the cost of installation and maintenance of subsea equipment. First, a platform has to be installed on the sea floor. Accurate positioning requires time and skill and installation can be affected by bad weather on the surface.

Once a platform is installed, the subsea equipment can be attached to the platform. Generally, this includes a wellhead, valve tree equipment, pipelines, structures and piping systems, and the like. The installation and maintenance of subsea equipment requires specialized and expensive methods, including regular diving equipment for shallow work up to 300 meters; one atmosphere diving equipment for work up to 700 meters; robotic equipment, generally remotely operated underwater vehicles (ROVs), for deeper depths; and, specialized ships equipped with large cranes to lower and raise equipment.

Subsea equipment installation is currently performed by first lowering the equipment using a large crane. Ship positioning and crane manipulation are paramount to accurately placing equipment. Affecting these methods is the length of cable guidelines needed for deeper waters wherein longer cables increase the effects of pendulum-like oscillations. Also, the weight and size of each load is limited by the crane's capacity (including the weight of the crane wire) and the crane's reach. Thus, larger facilities have to be broken down into many pieces to prevent overloading of the crane, resulting in even more bottom trips being made.

Once the equipment is near the sea floor, remote controlled vehicles (ROVs) are used to maneuver the equipment into the desired location before landing and to connect each component to the platform and to the subsea system.

Once all of the pieces are unloaded and installed on the subsea facility, the system is then tested for functionality. If there is a problem with system performance, then the troubled component(s) must be disconnected and brought up to the surface for repair or to be exchanged.

Therefore it is readily apparent that complete subsea installation procedure can be a lengthy and expensive process. Not every harbor has the specialty ships equipped with large cranes, which adds the cost of coordinating the special equipment and getting it to the deep-water site. Weather conditions limit installations due to potential damage from accelerating and decelerating forces during equipment pick-up and landing. This is especially important because many items being installed are delicate and can be damage by wave action. Lastly, simple repairs of the subsea facility can also be very expensive and time consuming if the ROVs are unable to complete the repairs underwater.

Because of these difficulties, much research in the realm of subsea oil and gas recovery focuses on methods of reducing installation cost and time. U.S. Pat. No. 4,909,671, for example, describes a method for installing a floatable or buoyant body on the sea floor. The body has a ballast system wherein the supply of ballast water is adjusted to allow the body to sink at a pre-selected velocity to a predetermined buoyancy neutral level, wherein the body is further lowered to the sea floor using a guide wire attached to a ship. As such, large structures can be lowered without the use of a conventional crane ship and independent of weather and climatic conditions. However, this patent does not address the installation of subsea equipment upon the platform, and equipment is still installed piece-by-piece.

Following the same trend, U.S. Pat. No. 6,752,100 describes a method of deploying and installing subsea equipment, particularly smaller, delicate components, using buoys instead of a ship equipped with a crane. The use of buoys essentially reduces any effect from vessel motion that may affect the accuracy of positioning the equipment. US20110164926 also uses a buoyance system for lowering equipment, however, a control weight is used to overcome the positive buoyancy of the system. In both inventions, the use of a buoyance system allows for a gentler landing of the delicate equipment. However, neither addresses the complete subsea facility installment.

Of additional concern is the cost and time needed for performing intervention or maintenance operations on a subsea facility. US20010240303 describes a subsea intervention module with a buoyance system and a navigational control that allows for the module to be lowered via a guide wire attached to a ship to the subsea well head without hitting the sea floor or the well head with force. Thus, ships specially equipped with large cranes and ROVs are not necessary for docking the intervention module. Furthermore, the intervention operation can be controlled on the surface, thus eliminating the need to launch a ROV.

The art to date, however, focuses on cost reduction to single elements of the entire installation procedure. Thus, what is needed in the art is a complete subsea facility that can be installed with minimal cost at each installation step. Specifically, what is needed in the art is a subsea facility that can be installed and maintained without help or with reduced help from cranes, rigs and ROVs. Furthermore, the installation must be able to occur independent of weather conditions and must be safe for delicate and smaller items.

SUMMARY OF THE INVENTION

The present invention involves a modular subsea facility and a method for installing it in deep waters with minimal use of ships specially equipped with large cranes, and with fewer installation trips. Therefore, the current invention significantly reduces the cost and time of installing a subsea facility.

The present invention discloses a subsea facility wherein the equipment is installed on one or more modules that are equipped with a buoyancy system and a buoyancy control assembly to control the floatability of the modules. Thus, each module can be raised or lowered independent of the others.

The modules are directly attached together quayside using latching devices to form a floatable subsea platform (FSP). Alternatively, the modules can be attached to a subplatform base. As yet another embodiment, combinations of directly connected modules and modules connected to one or more subplatform bases can be used. Either way, individual modules can still be singly raised for servicing and repairs.

Furthermore, the entire system or parts thereof can be surface and subsea tested before being towed to a preselected deep-water site. Once the subsea facility reaches the site, the FSP is slowly lowered using controlled buoyancy and a guide wire from a conventional winch attached to a barge. After reaching the sea floor, the entire facility can be moored or anchored in any convenient way, usually onto a pre-installed template with suction piles, stabbing guides or another similar device.

In the present invention, it is preferable that the subsea system testing be performed in air and/or in shallow water quayside. Thus, any repairs or modifications can be made at the surface and are relatively inexpensive. Furthermore, many ports already have cranes and winches available for putting the FSP together, thus special equipment may not need to be brought in.

The whole FSP assembly can be towed, with all equipment preinstalled, connected and tested, to the subsea site. The assembly can also be towed piecewise as well, based on size considerations and what existing equipment has already been installed subsea. Additionally, the FSP can be towed with barges equipped with conventional winches. The winches can be used to hold the FSP as it is lowered to the sea bottom.

The size of the modules can be adjusted in relation to the equipment. Also, a large piece of equipment, such as a manifold, can be attached to multiple modules if so desired. Modules can contain any of the equipment needed for subsea operations, including drilling or wellhead systems, mud pumps and other pumps, blowout protectors and other chokes and flow modules, control systems, electrical connections, tie-in and flowline connections, manifolds, Christmas trees, umbilicals for providing necessary energy (electric, hydraulic), control and chemicals to subsea oil and gas wells, risers or other conduits for delivering oil to the surface or to a temporary submersible storage tank, separators and other processor systems, mooring systems, ROV tie-ins, specialty tools, and the like.

Each module will also have one or more buoyancy tanks and a buoyancy control assembly. The buoyancy control assembly can be any known in the art or to be developed. Typically such control assemblies include, but are not limited to, air hoses attached to air compressors on a surface vessel and leading to the ballast tanks, and buoyancy monitoring/regulating or control devices to control the air compressors and/or delivery of air to the tanks.

The buoyancy system includes, but is not limited to, the buoyancy control assembly, and floating tanks, ballastable tanks or unballastable tanks, and the like. The tanks can be either a separate attachment on the platform or can be part of the module, or combinations thereof.

The modules also contain latching devices to attach multiple modules together or to a subplatform base and to mooring clamps to attach the modules (or the subplatform base) to the sea floor template. Many latching and mooring devices are already known and commercially available, thus one skilled in the art would be able to select fasteners that complement the subsea facility and working environment.

For example, WO2011/083268 describes a subsea anchoring assembly, First Subsea offers ballgrab mooring systems, Gael Force offers the SeaLimpet Mooring Device, SBM Offshore N.V. offers Single Point Mooring (SPM) systems. Other companies offering mooring devices and/or services include Viking Mooring, Delmar, and Offspring International Ltd to name just a few. Similarly, Oceaneering offers an API 17D latch system, which allows ROV replacement of modules. Oil States offers the RotoLatch™ Subsea Latch System. Halliburtan and Schlumberger also offer various latching and/or mooring systems.

Ideally, the latching and or mooring devices are electronically controlled and can be integrated with the subsea control pod to allow for surface control. Thus, ROVs are not needed to disconnect the module. However, ROV devices can be used as well. Additionally, acoustically controlled connecting devices can be utilized, such as those described in US20120000664.

In one embodiment, the modules are generally rectangular in shape to allow for better fit. However, other shapes are also possible.

In one embodiment, multiple floatable platforms, arranged in a boxlike fashion, have equipment fastened and connected on the upper side and floating tanks on the edge. Multiple floatable boxlike platforms can also be connected. The boxlike components need not be cubes or have perfect right angles, but can include prisms and other shapes.

In another embodiment, the floatable subsea platform has a grillage-like structure made up of beams to form a structural framework, with equipment fastened and connected to the upperside. Ballastable or unballastable tanks are also connected to the frame using fasteners. Tanks can be positioned on the edges, the top surface, or even underneath the top surface (e.g., inside the framework), as is convenient for assembly of the modules and placement of equipment and to provide buoyancy and underwater stability.

In yet another embodiment, the floatable subsea platform has rectangular modules connected in a free form shape wherein there are open areas within the overall structure. This allows for a variety of subsea facility designs without the need to incorporate empty modules.

As used herein, "subsea" refers to seabottom operations, such as seabottom drilling and the like.

The phrase "platform" means a generally flat structure that provides support for the subsea facility and equipment. When buoyancy systems are attached, the platform becomes floatable. The "modules" discussed herein have a platform on which various equipment and latching devices are positioned.

As used herein, "subsea facility" includes the entire subsea setup, including the recovery systems, production systems, pipes or umbilical's connecting the facility to the surface or underwater pipelines, and any other underwater oil and gas production system or equipment currently known or developed in the future.

As used herein, "floatable subsea platform" or "FSP" means a subsea platform comprising one or more detachable equipment modules, as well as buoyancy systems, such that the platform can be towed into place, and submerged and anchored to the sea bottom.

As used herein, a "subplatform base" is a basic structure to which the modules can be anchored, although the subplatform base can be omitted in some embodiments, and the modules directly connected to each other and anchored to the sea floor.

As used herein, "subsea equipment" means any of the equipment used in subsea oil and gas exploration, subsea production or subsea processing. This includes manifolds, control pods, trees, pipes, connectors, drilling systems, etc.

As used herein, "buoyancy control assembly" means all the equipment necessary to monitor and control the buoyancy of the FSP and/or individual modules thereon. This includes all sensors, gauges, pumps, hoses, gas source, and the like.

As used herein, "buoyancy tanks" are tanks that can contain air or other gas and which are controlled by the buoyancy control assembly. These tanks can be ballastable, i.e. take in or release water, or unballastable.

The buoyancy tanks and the buoyancy control assembly together make up the "buoyancy system", allowing the FSP or individual modules to be raised and lowered.

As used herein, "grillage" refers to a device made of a framework of interconnected beams in a repeating pattern, e.g., usually triangular or rectangular, thus reducing weight without compromising strength or stability.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| FSP | Floatable subsea platform |
| ROV | Remotely operated vehicles |

DESCRIPTION OF EMBODIMENTS OF THE INVENTION

Figure 1:
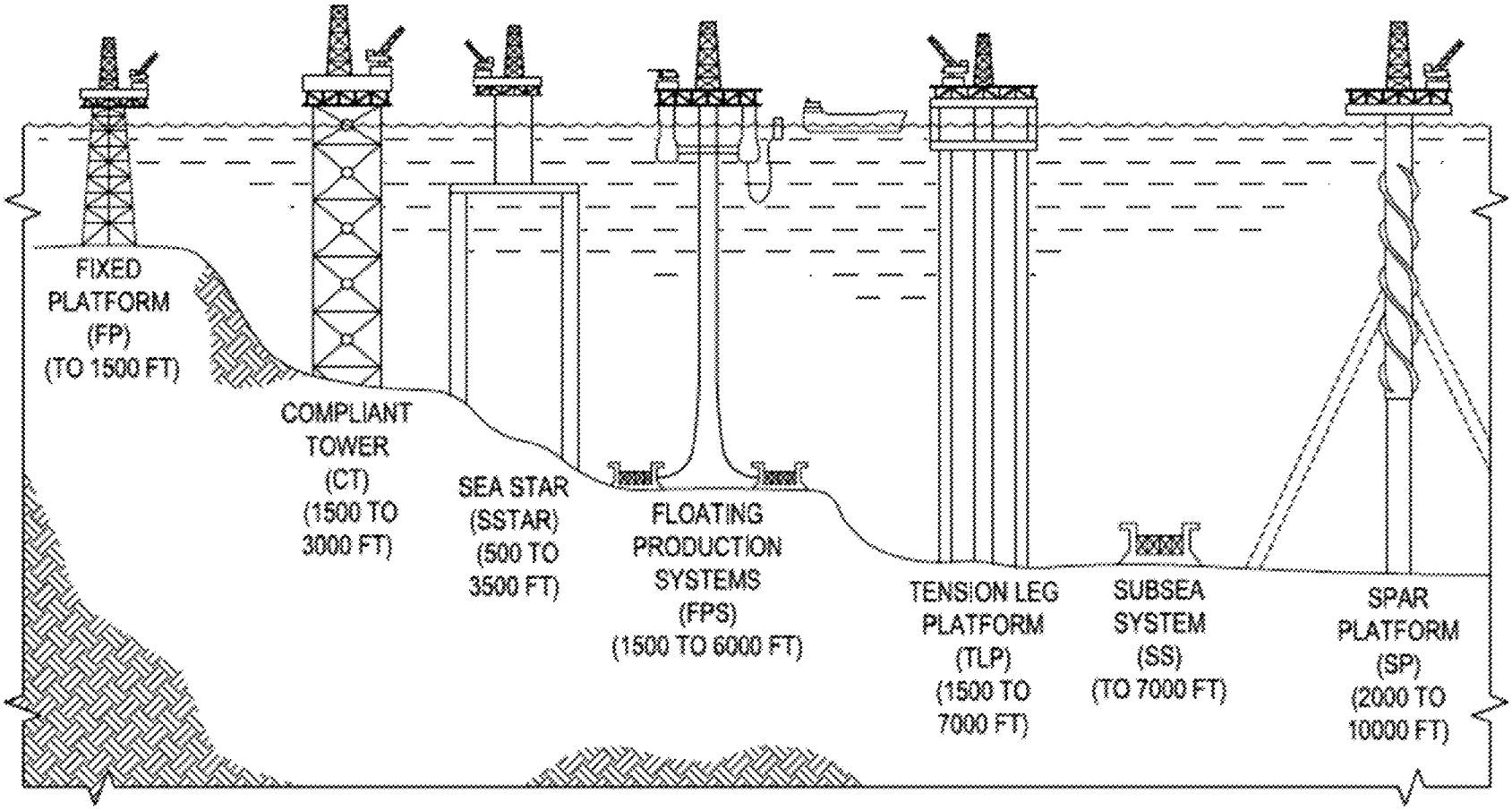
FIG. 1 displays the different types of commonly used deepwater production systems.

The invention provides a novel subsea facility wherein the entire facility is attached to one or more modules equipped with buoyancy tanks. The modules can be latched together quayside to form a floatable subsea platform (FSP), or can be connected to one or more subplatform bases, or combinations thereof based on size, weight and towing considerations.

With this design, the subsea equipment can be connected and tested in the air or shallow water before being towed to the deep water well location, wherein the entire platform or subparts thereof, can be lowered, via controlled buoyancy, to the sea floor where the FSP is attached to a pre-installed template or other anchorage devices. It is believed that by setting the system up quayside, any repairs and installation issues can be performed quickly and without the specialized equipment and personnel normally needed for deep water installations, thereby reducing installation cost and installation time.

Additionally, by having the subsea facility spread out over multiple modules, an individual module, a set of modules, or the entire platform can be disconnected and selectively raised for repairs on the surface. Surface repairs have significantly lower costs because ROVs or other specialty underwater equipment are not necessary and surface repairs are quicker.

Without this technology, the subsea equipment would have to be offloaded via a large crane and hooked up piece by piece and tested underwater by ROVs, which can be very expensive and time consuming. Furthermore, repairs would also require the use of ROVs or cranes if the equipment has to be replaced.

FSP Design

The makeup of subsea facilities is specific to the location and working conditions of the well and the production goals. For example, subsea facilities located in the Barents Sea require special equipment to protect against moving ice, whereas subsea facilities in the Gulf of Mexico would not. Thus, it would be difficult to list all the potential combinations of equipment that can be included on the FSP. As such, the present invention preferably utilizes generally rectangular modules to accommodate the various subsea facility needs and the various equipment designs.

However, modules of other shapes can also be used and a mixture of modules of varying shapes in a single FSP may also be possible. For example, hexagons can be of regular shape, yet easily fit together, as can triangles. As another example, four rectangular modules can be fitted together with or without a central opening.

Generally, large components such as manifolds, control pods and trees can be included on one or more modules, but it is preferred that a large piece of equipment be limited to a single modules for stability reasons. Portions of the jumper system, pipes and the umbilical or tie-ins for same can also be attached to the modules. Subsea facilities also have smaller components such as specially designed values and choke trim, pipeline, etc., that are expected to be replaced or repair during the course of the subsea facility's lifetime. Without the present invention, these pieces are usually recovered and replaced using free-swimming ROVs. However, certain of these components can be attached to a single module that can be floated up separately and with little to no ROV use.

The modules also have a buoyancy system to provide the FSP's floatability. The buoyancy system consists of tanks that can be flooded or emptied. The buoyancy tanks can include, but are not limited to, floating tanks, ballastable tanks, unballastable tanks. The tanks can be either a separate attachment on the module or can be integrated into the structure of the module. Tanks can also be on the subplatform base, but may not be essential if the modules themselves provide sufficient buoyancy to float the entire assembly. Tanks and/or the entire buoyancy system can also be detachable or removable and used for other modules, thus saving equipment costs, leaving only enough tanks sufficient to float one or two modules at a time.

The buoyancy controlling assembly monitors and controls the FSP's buoyancy. It includes buoyancy monitoring/regulating devices, air hoses attached to air compressors on the module itself or the towing vessel (usually a barge), and connects to the buoyance tanks. The controlling equipment can also be integrated into the subsea control pod to allow for operator control on the surface, too. Using air for buoyancy control is one inexpensive option, but other gases or solid or liquid low-density materials could also be used.

The modules can be of any design, particularly a flat, solid platform design with attachments on the upper side for the subsea equipment and buoyancy system. A preferred design is a grillage structure composed of beams, arranged in typical triangular, rectangular or square repeating patterns. Grillage structures may be preferred as minimizing weight and materials, while still providing adequate strength. A given FSP can contain modules of any design, thus allowing for inclusion of any subsea equipment.

Lowering the FSP

The FSP is lowered using the buoyancy system. The buoyancy in the attached tanks are monitored and changed with the assistance of a buoyancy control assembly to maintain neutral buoyancy. However, a vessel, such as a barge, equipped with a winch is also necessary to provide guide wires to control the descent of the FSP.

Figure 2A:
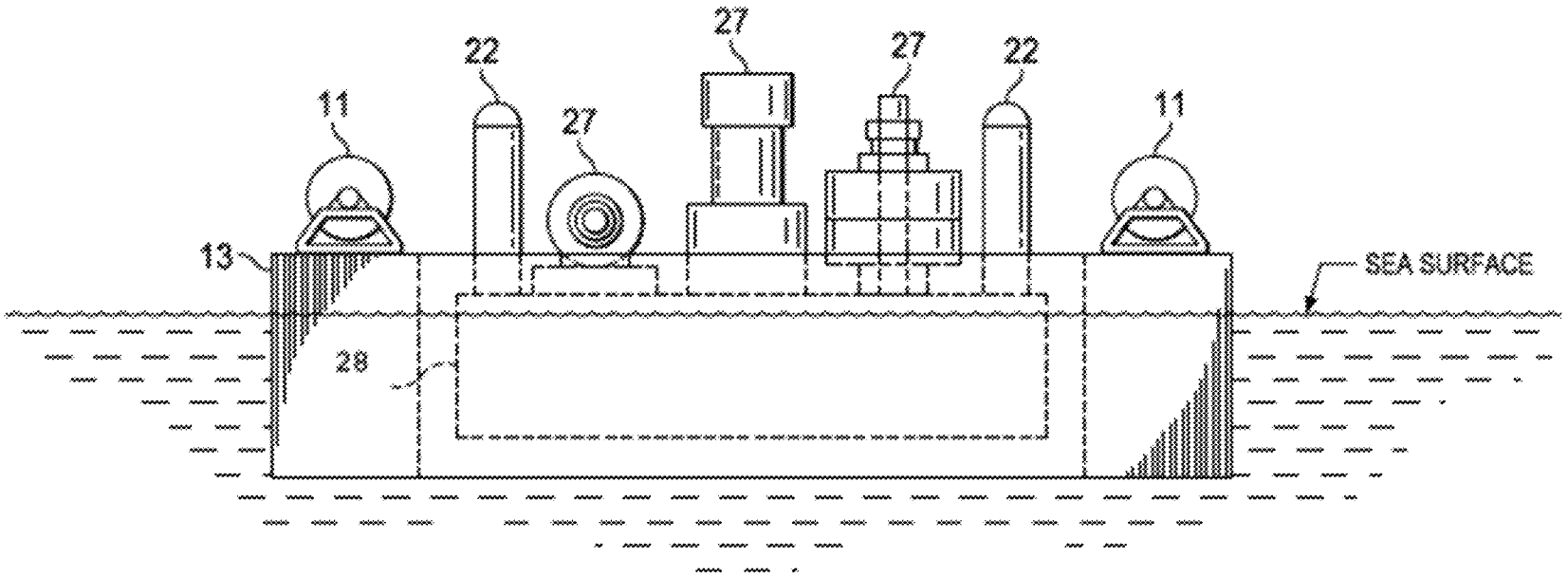
FIG. 2A displays a side view of the FSP carried on a square donut barge.
Figure 2B:
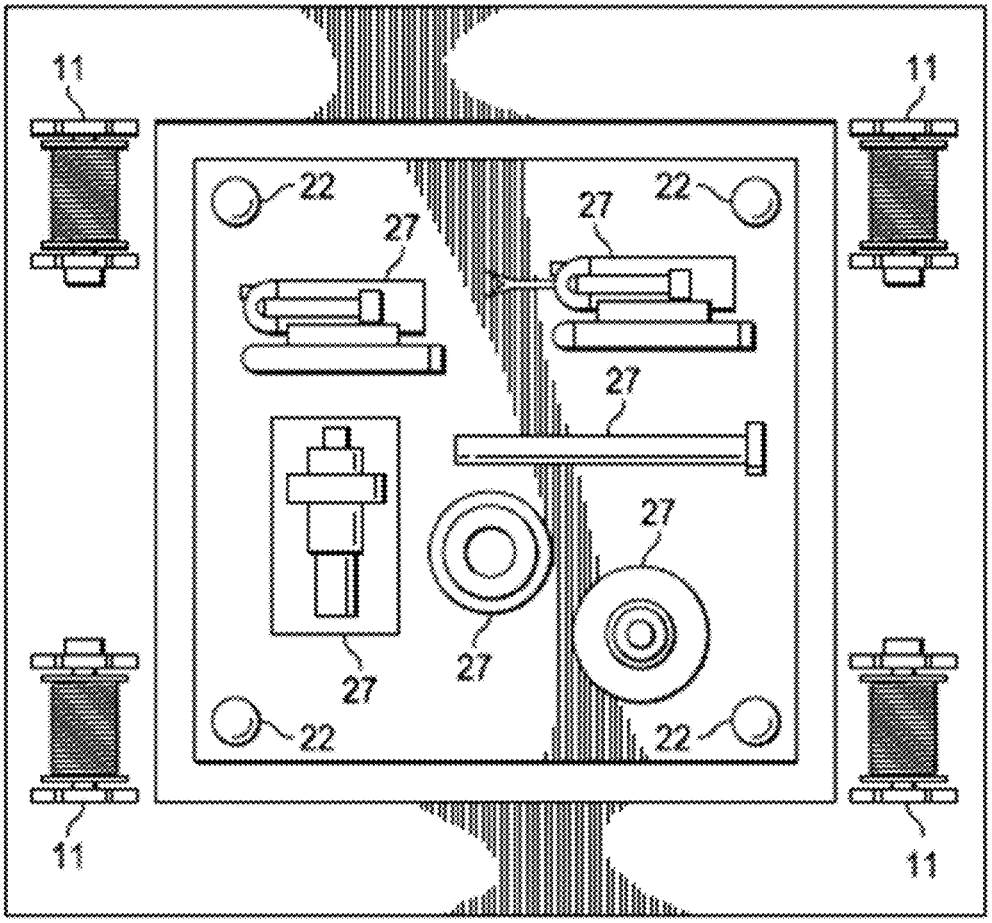
FIG. 2B is a top view of the FSP in the donut opening of the barge.
Figure 2C:
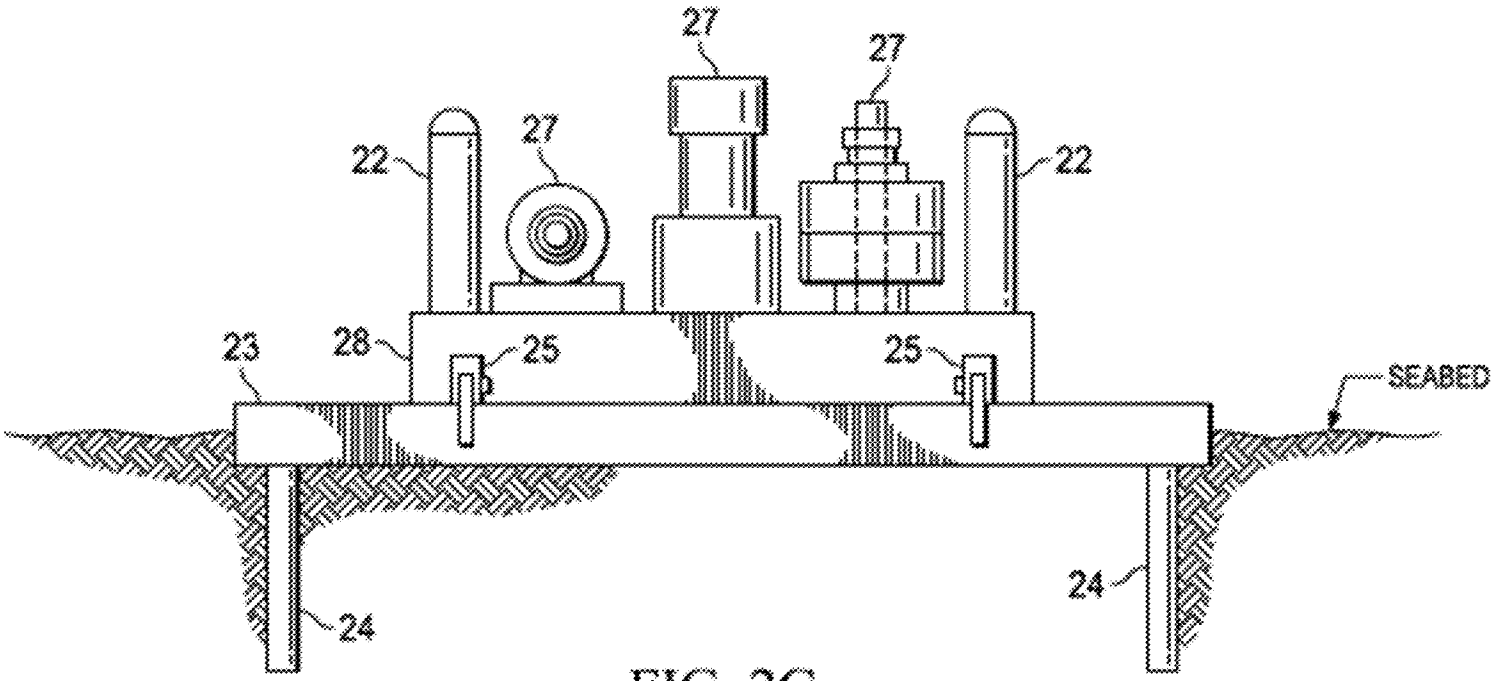
FIG. 2C is a side view of the modules installed on the template of the sea floor.

FIG. 2A-C displays the setup for an installation from a square donut barge equipped with winches, and the installed FSP. Here, the FSP modules are initially placed in an open section in the middle of the barge 13 via cranes quayside. Although shown with a moon pool, this is optional, and the platform can be towed by the side of a barge. The equipment is connected and tested while the FSP is on the surface and can also be tested subsea in a shallow location before being towed to the drilling site.

The barge and the FSP are then towed to the well site. Guide wires and/or umbilicals for the winches 11 are attached to the FSP 28 as it is lowered to the sea floor. Because the FSP 28 is neutrally buoyant, the barge and winches can easily hold the FSP and the winches need not be very large.

As an alternative to the specialty barge, one or more barges of the common barge design can be equipped with conventional winches and used to lower the FSP.

It should be noted that lowering the FSP using conventional winches and barges reduces the extensive planning, time and cost typically required for subsea installation. Normally, vessels specially equipped with cranes are used. These vessels may not be located at the closest port to the well location. Thus, extensive planning is required to coordinate the various specialty vessels and ROVs equipment and operators. However, barges are commonplace in most ports and their use is easier to coordinate than a specialty ship that has to travel from more distant ports. Thus, much less advance planning is required with the FSP installation.

Because the FSP is already located on the sea surface for towing, and is not being lifted off of a vessel, this type of installation can occur in a broader range of weather conditions. Also, the assistance buoyancy controlling assembly can slow the ascent of the FSP near the sea floor, thus allowing for a gentler landing and less potential damage to the equipment.

Once the FSP is positioned on the pre-installed template, ROVs can be deployed to latch the FSP to the template and to connect the subsea system to the well (see FIG. 2C).

In FIG. 2C the subsea equipment 27 is on FSP 28, which has top mounted flotation tanks 22. Latching devices 25 attach the FSP 28 to the template 23 on the sea floor, which is anchored in place by any known means, in this case piles 24. Latching devices of any type may also hold the subsea equipment 27 to the FSP 28 but are omitted herein to simplify the figure.

Figure 3:
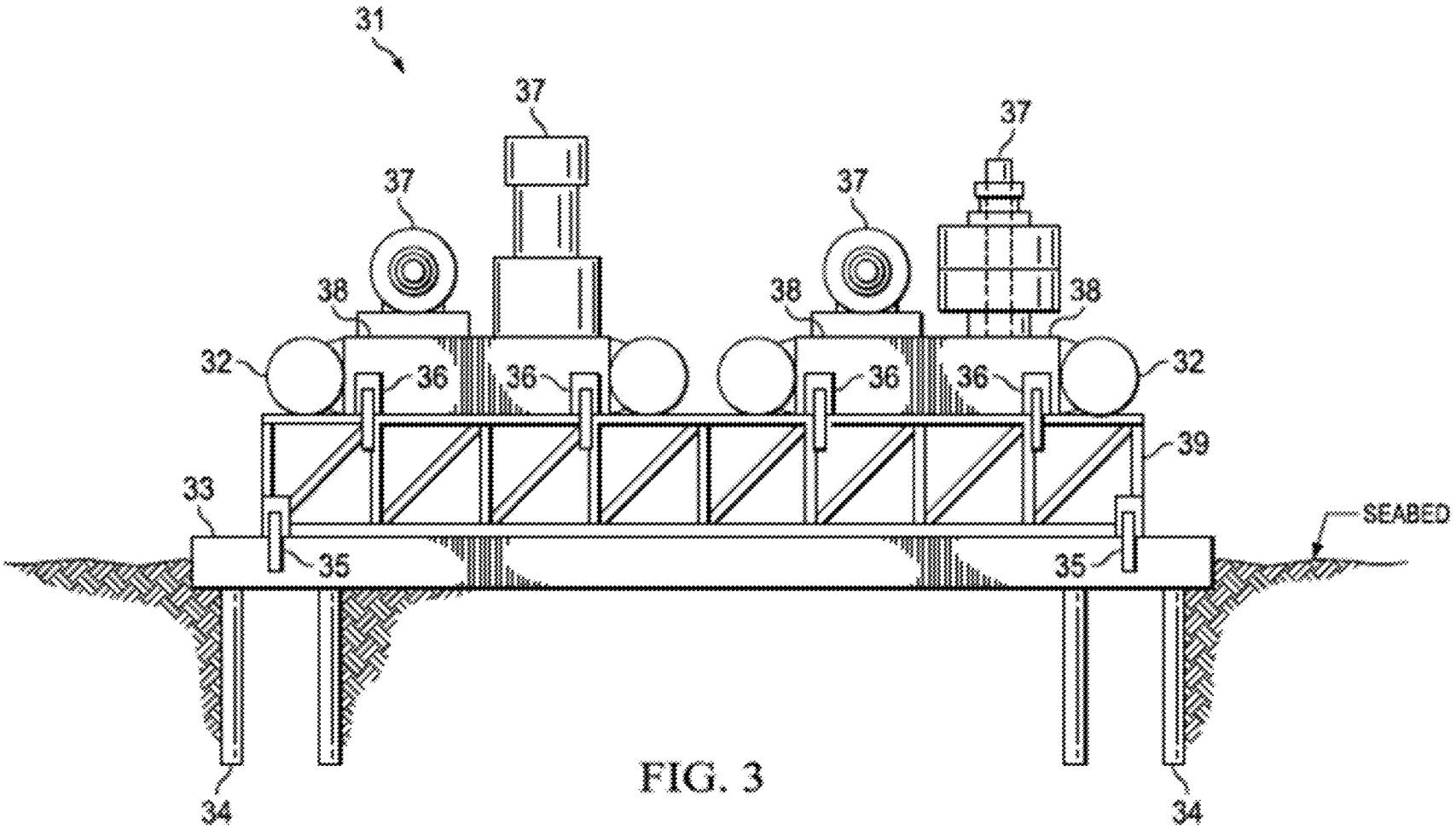
FIG. 3 displays a side view of two modules with side mounted buoyancy tanks on a subplatform, which is then installed on the template of the sea bottom.

FIG. 3 shows another variation 31, wherein a subplatform 39 has two FSP 38 modules thereon, each with buoyancy tanks 32. These tanks are shown side mounted, but can be in any convenient position, e.g., on top as in FIG. 2 or inside the grillage as in FIG. 5. The subplatform may also have buoyancy tanks if needed, but not shown here. Although side positioned tanks 32 take up lateral space, they can also be easily disconnected and used to bring another module to the sea pad 33. Latches 35 hold the subplatform to the template 33, which is anchored e.g., with piles 34. Additional latches 36, of the same or different types, hold the FSP modules 38 to the subplatform 39. Latching means to hold the equipment 37 on the FSPs 38 are omitted for clarity.

Figure 4:
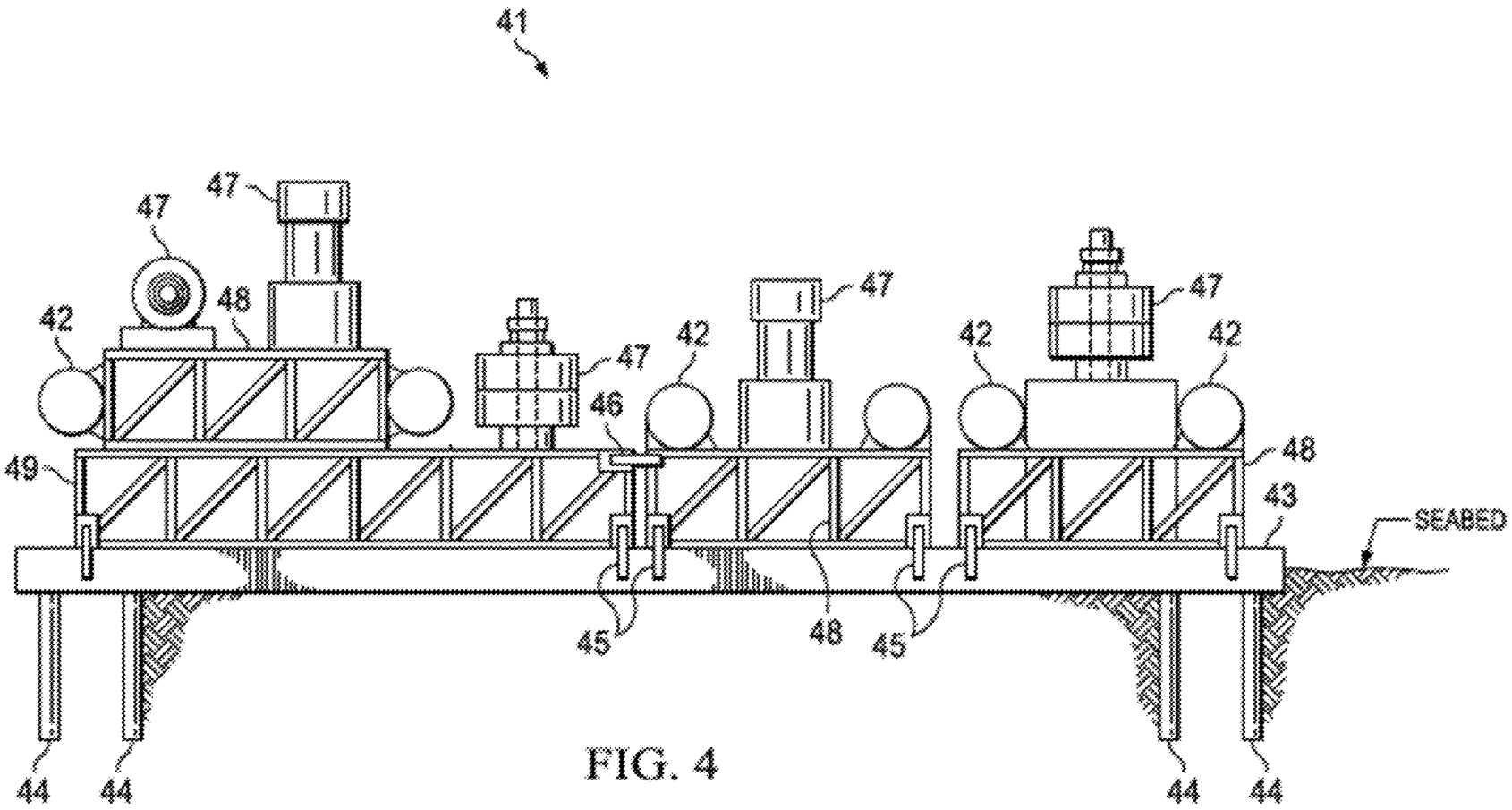
FIG. 4 shows two modules with side buoyancy tanks, installed directly on the template on the sea floor, with a subplatform having another module thereon, as well as subsea equipment directly thereon.

FIG. 4 shows a variation 41 wherein some FSP modules 48 are connected directly to the pad or template 43, and some are connected to a subplatform 49. This subplatform 49 also has subsea equipment 47 mounted directly thereto. Various attachments devices 45, 46 are used to connect components together or to the template 43, which is anchored via piles 44, but can use any conventional anchoring system. Tanks 42 are shown in top or side positions, and buoyancy control systems are omitted for clarity.

Figure 5:
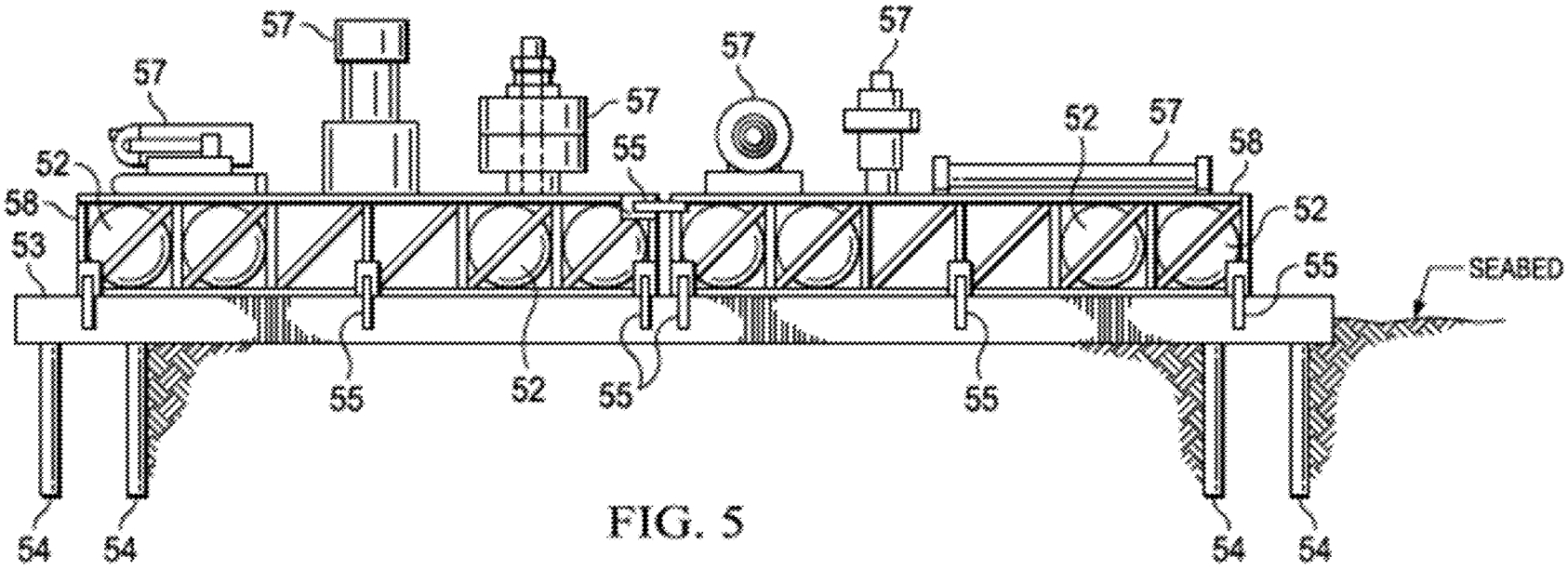
FIG. 5 shows a side view of two modules, with buoyancy tanks contained inside the grillage of the module and with subsea equipment thereon, both modules anchored to the template, which is anchored to the sea bottom.

FIG. 5 shows yet another variation wherein two grillage FSP modules 58 have buoyancy 52 tanks within the perimeter of the modules 58. Clamps 55 connect the modules 58 to the template 53 anchored by piles 54, and subsea equipment 57 is placed on the modules 58. After a period of use, any one of the modules can be disconnected and floated to the surface for overhaul.

Thus, a variety of different footprint plans are available for the FSP modules, and the design can easily be varied to accommodate a variety of equipment and servicing needs. It is noted that the simple diagrams shown herein with a rectangular prism shape, but the modules can also be trapezoidal, having a wider base for stability, or have legs to position the equipment at a higher level. For example, a modules containing a variety of piping (e.g., a manifold) can be set on legs so as to fit over a lower unit containing pumps and such. Further, as already discussed the top view need not be rectangular, although regular shapes are preferred for ease of fitting modules together. A particularly preferred shape has square 1×1 square units (as seen from a top view) mixed with rectangular 1×2 units, 2×2 units etc. such that the sizes are multiples of the basic unit size and can easily be fitted together.

Maintanence and Intervention

For subsea facilities, maintenance and interventions are usually performed by ROVs under water. Because the ROVs are being controlled by a skilled operator on the surface with only a video feed of the facilities, even simple repairs can be costly and time consuming. When items have to be replaced, large cranes can become necessary. Furthermore, multiple trips bringing up and lowering equipment may have to be made before the system is back online and working as planned.

With the present invention, however, the module containing the piece requiring repair or maintenance can be unlatched via an operator and floated to the surface. Thus, the work can be performed without the added complexity and expense of ROV operations. Furthermore, depending on the system, the entire FSP can be raised, repaired and tested in the air to ensure everything is in working order, or individual modules can be raised and serviced.

The following are incorporated by reference in their entirety:

U.S. Pat. No. 4,909,671
U.S. Pat. No. 6,752,100
US20110164926
US2001024140303

What is claimed is:

1. A method of installing a floatable subsea platform on a sea floor, comprising:

providing a subplatform base, a plurality of connectable modules with subsea equipment positioned on each module, and a buoyancy system with at least one buoyancy tank operably connected to a buoyancy control assembly;

latching the plurality of connectable modules to the subplatform base;

towing the subplatform base with the plurality of connectable modules by a barge to a sea bottom oil site, wherein the buoyancy system floats the subplatform in water during the towing after the latching;

wherein the subplatform base is placed in a moon pool of the barge and is hence disposed in water and surrounded by the barge while being towed;

mooring a template to the sea floor at the sea bottom oil site;

lowering the subplatform base to the template using the buoyancy system; and latching the subplatform base to the template.

2. The method of claim 1, wherein the subsea equipment is different on a first one of the plurality of connectable modules than a second one of the plurality of connectable modules.

* * * * *